US006499382B1

(12) United States Patent
Lougheed et al.

(10) Patent No.: US 6,499,382 B1
(45) Date of Patent: Dec. 31, 2002

(54) AIMING SYSTEM FOR WEAPON CAPABLE OF SUPERELEVATION

(75) Inventors: James Hugh Lougheed, Kinburn (CA); David Norman Green, Ottawa (CA); Stephen David Shaw, Carp (CA); Thomas Mark Walter Bottomley, Orleans (CA)

(73) Assignee: General Dynamics Canada Ltd., Nepean (CA)

( * ) Notice: Subject to any disclaimer, the term of this patent is extended or adjusted under 35 U.S.C. 154(b) by 0 days.

(21) Appl. No.: 09/378,720

(22) Filed: Aug. 23, 1999

(30) Foreign Application Priority Data

Aug. 24, 1998 (CA) ..... 2245406

(51) Int. Cl.[7] ..... F41G 3/06

(52) U.S. Cl. ..... 89/41.05; 89/41.17

(58) Field of Search ..... 89/41.05, 41.06, 89/41.17, 41.18

(56) References Cited

U.S. PATENT DOCUMENTS

| | | | | |
|---|---|---|---|---|
| 2,284,611 A | | 5/1942 | Barnhart | 89/41 |
| 2,359,032 A | | 9/1944 | Gott | 89/41 |
| 2,570,298 A | * | 10/1951 | Wheeler | 89/41.17 |
| 3,710,675 A | | 1/1973 | Asikainen | 89/41 B |
| 3,766,826 A | | 10/1973 | Salomonsson | 89/41 B |
| 3,824,699 A | | 7/1974 | Lenz et al. | 33/334 |
| 4,193,334 A | | 3/1980 | Jackson | 89/41 E |
| 4,577,546 A | | 3/1986 | Jackson | 89/41.19 |
| 4,760,770 A | * | 8/1988 | Bagnall-Wild et al. | 89/41.19 |
| 4,787,291 A | | 11/1988 | Frohock, Jr. | 89/41.22 |
| 5,686,690 A | | 11/1997 | Lougheed et al. | 89/41.17 |
| 5,949,015 A | * | 9/1999 | Smith et al. | 89/41.05 |

OTHER PUBLICATIONS

*WIth SACMFRCS, Their First Move . . . will be Their Last*, EOS Electro–Optics Systems, Contraves2004/92 4 pages.
*New Grenade Launcher Offers First Shot Hits, Greater Lethality via Smart Ammo*, Virgina Hart Ezell, Nation Defence Feb. 1998. p. 46.
*ML19 Mod 3 40mm Daylight Optic & Adjustable Sight/ Bracket*, Saco Defense Incorporated.

* cited by examiner

*Primary Examiner*—Stephen M. Johnson
(74) *Attorney, Agent, or Firm*—Thomas Adams

(57) ABSTRACT

A grenade machine gun or other weapon which employs superelevation of the barrel comprises a barrel unit and an aiming system mounted upon a support. The aiming system is mounted to the weapon and the support by a coupling unit. The aiming system comprises an imaging and display unit for displaying an image of a scene including a target, angle encoders for providing a signal representing displacement of the imaging unit in elevation relative to the support, and a control unit, e.g. a computer, for selecting either of two states for the coupling unit. The first state entrains the imaging unit to move with the barrel. The second state secures the imaging unit to the support and allows the barrel to move relative to both, i.e. during superelevation of the barrel. The coupling unit may comprise a first part connected to the weapon for rotation in elevation with the barrel unit and a second part connected to the imaging unit. The control unit may comprise a computer for superimposing upon the image an aiming reticle and a rangefinder reticle, the former representing an aiming point of the imaging unit and the latter representing an aiming point of the rangefinder, and may adjust the position of the aiming reticle in dependence upon the elevation signal, and stores coordinates for selected positions. The control computer may offset the displacement signal to displace the aiming reticle relative to the field of view in a direction opposite to the required superelevation angle.

21 Claims, 12 Drawing Sheets

AIMING SYSTEM FOR WEAPON CAPABLE OF SUPERELEVATION

TECHNICAL FIELD

The invention relates to weapon systems comprising a weapon and an aiming system and is especially, but not exclusively, applicable to weapons which employ superelevation of the barrel, such as grenade machine guns.

BACKGROUND ART

For some weapons, such as grenade launching machine guns, which fire relatively slow, heavy rounds, it is necessary to elevate the barrel by a relatively large angle, perhaps 30 degrees or more, above the sight line to the target. It is desirable to maintain the target image in view throughout the engagement to compensate for target changes, motion or other dynamic events. Modern weapons use sights with a high magnification to obtain precision aiming at large ranges. Such sights have a field of view of only a few degrees, increasing the likelihood that the user will lose sight of the target during "superelevation" of the barrel.

One known aiming system, known as the Small Arms Module Fire Control System (SACMFCS) by Contraves Inc., has the sight mounted upon a motorized tilting platform. Once the target has been ranged and the aiming point displaced downwards according to the computed superelevation, the motorized platform is driven to tilt the sight downwards a corresponding amount. The target then is out of the field of view, so the operator raises both the barrel and the sight until the target is in view again. The system is not entirely satisfactory because the target is lost from view during superelevation, and because precision, speed of operation, and ruggedness are required, tending to make a suitable motor drive large and expensive. Also, the platform increases the height of the display above the barrel, so the operator's head is exposed more than is desirable.

U.S. Pat. No. 4,193,334 (Jackson) issued Mar. 18, 1980 discloses a sight coupled to the weapon's barrel by way of a slip clutch so that the sight moves with the barrel during superelevation of the latter. The slip clutch allows the user to depress the sight relative to the gun barrel so as to view the impact of the round, and then return the sight to alignment with the gun barrel. However, the user still loses sight of the target while the gun barrel is being superelevated. Now that laser rangefinders are common, the target may be able to detect that it has been targeted by a laser rangefinder and take evasive action. It is important, therefore, to minimize the time taken between ranging the target, superelevating the gun barrel, and firing the gun. It is also desirable to minimize the time taken to select and fire at a series of targets in quick succession. Jackson's gun would be relatively slow because, not only must the sight be depressed to view the target, but it must then be returned manually to alignment with the barrel. During the time taken to superelevate the gun barrel and depress the sight to view the target again, the target might have moved, leading to inaccuracies. A further disadvantage is that the amount of superelevation is set by means of manually adjustable slides or scales.

U.S. Pat. No. 5,686,690 (Lougheed et al) issued November 1997 and commonly owned with the present invention, describes a weapon having a barrel and a sight mounted upon a support which can be rotated in azimuth but not in elevation. The gun barrel can be elevated relative to the support, but the sight cannot. Consequently, the sight remains trained on the target during the superelevation step. To change the field of view of the sight in elevation, however, the tripod must be adjusted or repositioned, which is awkward and time-consuming. A further disadvantage is that the rangefinder is mounted upon the gun barrel. Consequently, in order to range a new target, the user must depress the gun barrel until it is pointing directly at the new target again. Once the new target has been ranged, the gun barrel must be superelevated again. This is not satisfactory when there are multiple, fast-moving targets relatively close to each other. Yet another disadvantage is that the rangefinder and the sight must be boresighted to the gun barrel separately, which is time-consuming and makes it more difficult to obtain and maintain precise calibration.

SUMMARY OF THE INVENTION

One object of the present invention seeks to eliminate, or at least mitigate, the disadvantages of the above-mentioned weapon sights and to provide an improved weapon sight arrangement which permits the operator to view the target during superelevation of the weapon.

According to one aspect of the present invention, there is provided a weapon system comprising a weapon and an aiming system both mounted upon a support, the weapon having a barrel unit and the aiming system comprising:

(i) an imaging unit for providing an image of a scene within a field of view of the imaging unit;

(ii) a display unit for displaying the image;

(iii) the coupling unit having a first operational state in which the coupling unit fixes the imaging unit relative to the support while allowing elevation of the barrel unit relative thereto and a second, alternative state in which the coupling unit entrains the imaging unit to move with the barrel unit relative to the support, (iv) angle encoding means for providing a displacement signal representing displacement of the imaging unit in elevation relative to said first part; and (v) control means comprising means for controlling the coupling unit to select the first state and the second state alternatively and means responsive to the displacement signal for determining when a required change in elevation of the barrel unit relative to the support with the coupling unit in the first operational state has been effected and causing the display to provide an indication thereof.

The weapon system may further comprise a rangefinder for providing a range of a target in the field of view of the imaging unit, and the control means then may comprise:

a control computer unit comprising means for providing upon the image an aiming reticle representing an aiming point of the barrel once the imaging unit has been boresighted to the barrel unit and a ranging reticle representing an aiming point of the rangefinder, means for controlling the reticle providing means to adjust the position of the aiming reticle in dependence upon the displacement signal, and means for computing a required change in elevation of the barrel unit in dependence upon a range measured the rangefinder and applying a corresponding offset to the displacement signal so as to displace the aiming reticle relative to the field of view in a direction opposite the change.

The aiming system may further comprise means for providing an elevation signal representing displacement of a line of sight of the imaging unit relative to the ground and/or a cant signal representing inclination of the imaging unit relative to the ground. The control computer may take such cant and/or elevation signals into account when computing the required elevation.

According to a second aspect of the invention, there is provided the aiming system per se for mounting onto a weapon to form a weapon system according to the first aspect.

In embodiments of either of the first and second aspects of the invention, where the offset is sufficient to displace the aiming reticle beyond limits in the displayed scene, the control unit may be operable apply a part of the offset to maintain the aiming reticle at a position adjacent a corresponding edge of the field of view and monitor the remaining offset, restoring movement of the aiming reticle with the barrel unit once the barrel unit has been displaced by an elevation angle greater than that corresponding to said remaining offset. The control unit may change the appearance of the aiming reticle while the aiming point is outside the field of view.

The imaging unit may be mounted alongside the barrel unit and coupled to a separate display unit mounted immediately above handles at the rear of the barrel unit for controlling aiming of the weapon. Such an arrangement allows the weapon to have a relatively low profile.

The imaging unit may be completely electronic, such as a CCD sensor unit, or a hybrid of an optical sight with an electronically-controlled superimposed aiming reticle.

In embodiments of either of the foregoing aspects of the invention, the coupling unit may comprise means for fixing the imaging unit relative to the support, specifically a first clutch unit acting between the first part and the second part and engageable to entrain the imaging unit to move with the barrel unit in elevation relative to the support and a second clutch unit acting between the second part and third part and engageable to secure the imaging unit to the support, and switch means for engaging the first clutch unit while simultaneously disengaging the second clutch unit and vice versa.

Alternatively, the coupling unit may comprise a first clutch unit acting between the first part and the second part and engageable to entrain the imaging unit to move in elevation with the barrel unit, and a slip clutch acting continuously between the second part and the third part with sufficient force to retain the imaging unit in fixed elevational relationship with the support, providing the first clutch unit is disengaged, but insufficient force to prevent said movement of the imaging unit when the first clutch unit is engaged.

The means for controlling the coupling unit may comprise a user-operable switch.

Various objects, features, aspects and advantages of the present invention will become more apparent from the following detailed description of preferred embodiments of the invention, which are described by way of example only, taken in conjunction with the accompanying drawings.

DESCRIPTION OF THE PREFERRED EMBODIMENTS

Figure 1:
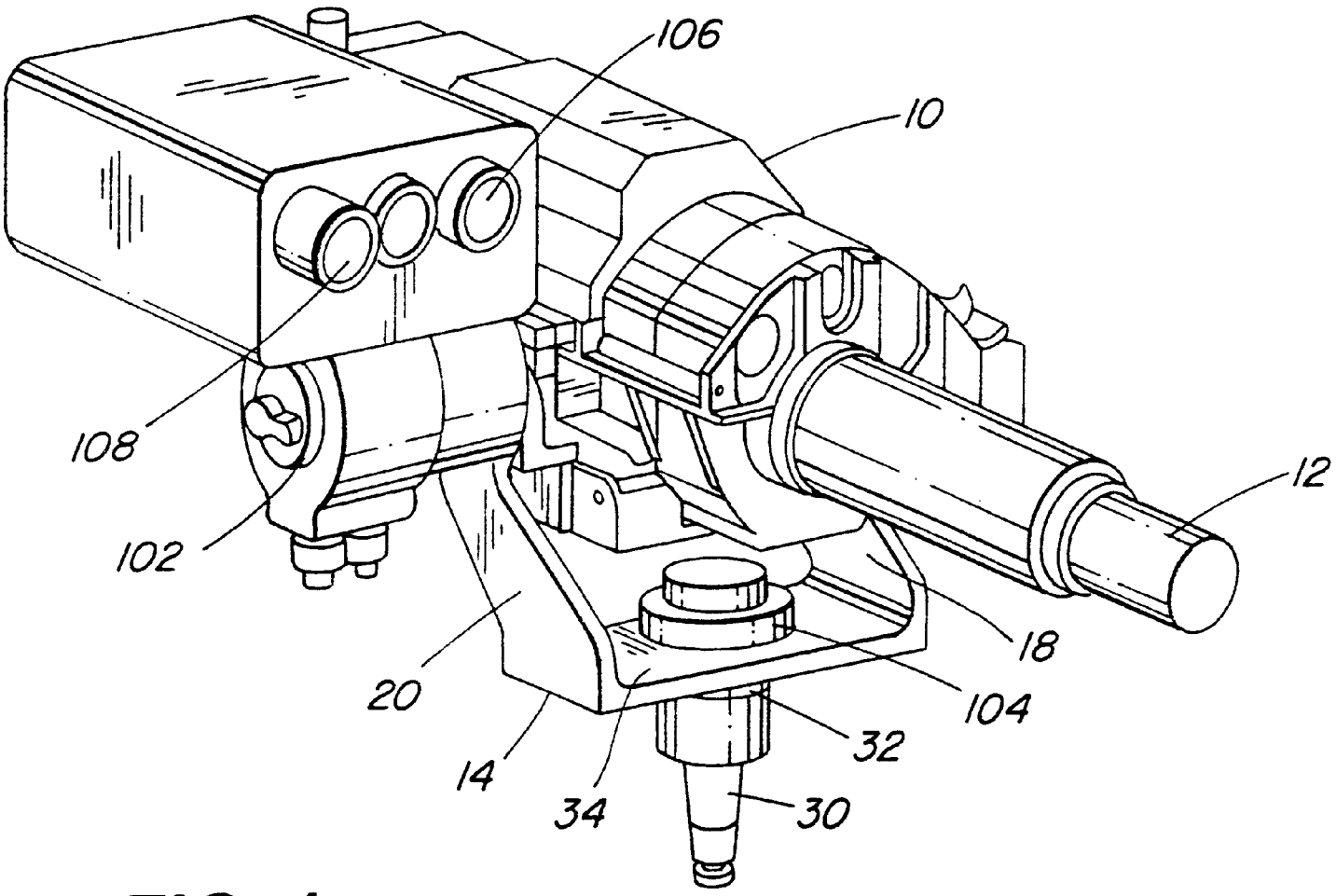
FIG. 1 is a front perspective view of a weapon and aiming system according to a first embodiment of the invention.

In the drawings, identical or corresponding items in the different Figures have the same reference numeral, a double prime signifying a modification.

Figure 2:
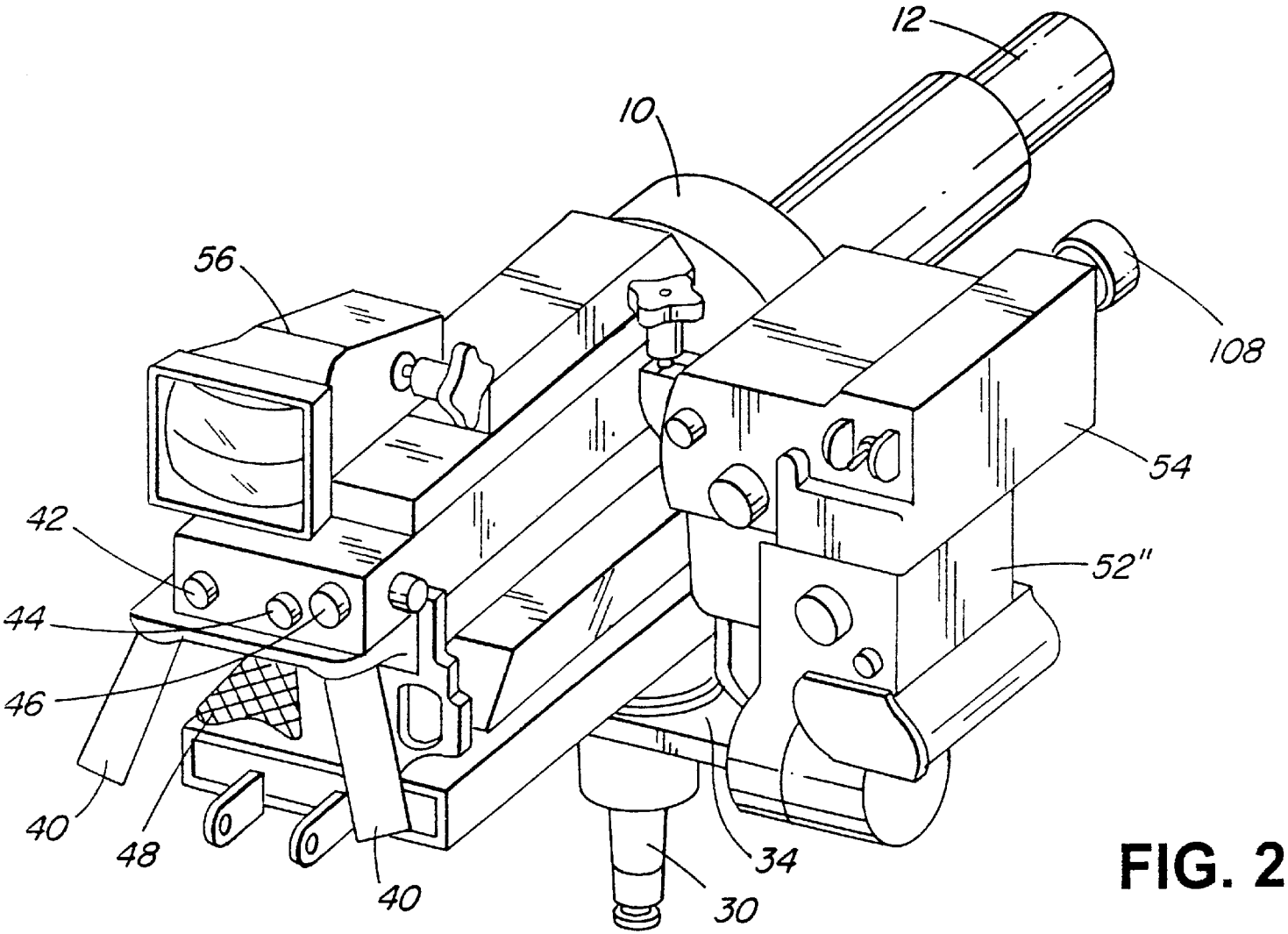
FIG. 2 is a rear perspective view of the weapon of FIG. 1 but with a modified aiming system mounting.
Figure 3:
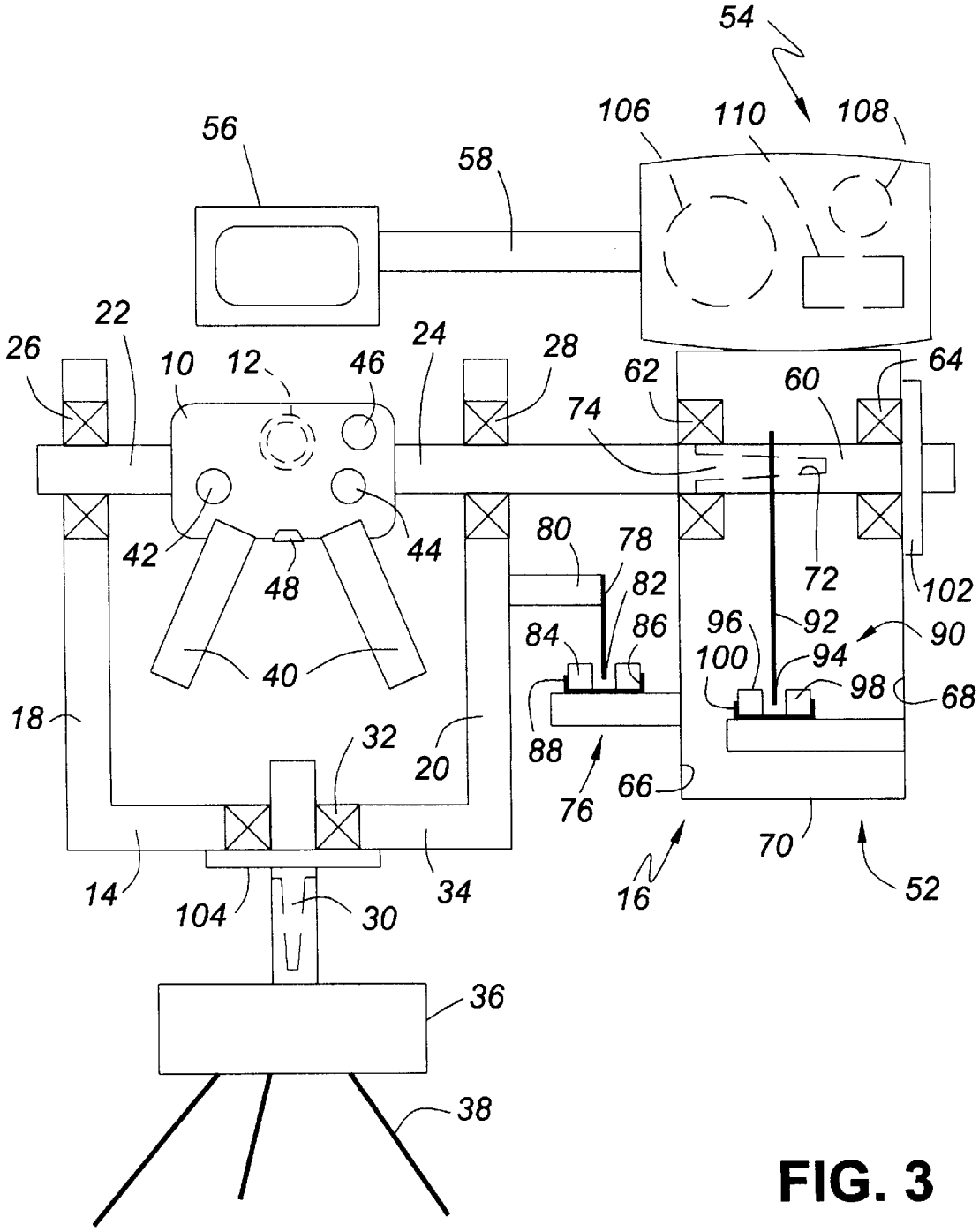
FIG. 3 is a schematic diagram of the weapon and aiming system of FIG. 1 taken from the rear.

Referring to FIGS. 1, 2 and 3, a weapon system embodying the invention, specifically a grenade machine gun, comprises a weapon body 10 having a barrel 12 mounted in a cradle mount 14, with an aiming system 16 mounted to one side of the cradle mount 14. The cradle mount 14 has upstanding arms 18 and 20 extending one from each side of the weapon body 10. Journals 22 and 24 (see FIG. 3) project from opposite sides of the weapon body 10 and into bearings 26 and 28 in arms 18 and 20, respectively, permitting the weapon to pivot in elevation relative to the cradle mount 14.

A tapered pintle 30 fixedly secured in a central base unit 36 of a tripod 38 projects upwards through a bearing 32 in a bight portion 34 of cradle mount 14. Hence, the cradle 14 can rotate in azimuth relative to the tripod 38. Handles 40 at the rear end of the weapon body 10 allow the user to pivot the weapon in elevation and azimuth. Three control push-buttons 42, 44 and 46 are disposed adjacent the handles 40 so that they can be operated by the user, as will be described later. A trigger 48 is positioned between the two handles 40.

The aiming system 16 comprises a coupling unit 52 and a sight unit 54 which is supported upon the coupling unit 52. A display unit 56 is mounted upon the sight unit 54 by means of a rearwardly-extending support arm 58, so that the display unit 56 is immediately above the rear portion of the weapon body 10. The support arm 58 may also carry electrical connections (not shown), A support shaft 60 extends through bearings 62 and 64 in opposite sidewalls 66 and 68, respectively, of a housing 70 of the coupling unit 52. The end portion of shaft 60 supported by bearing 62 has a tapered hole 72 to receive a mating tapered end portion 74 of journal 24 which projects beyond bearing 28 and cradle 14. The shaft 60 thus constitutes a first part of the coupling unit that is connected to the weapon for movement in elevation with the barrel 12. The housing 70 constitutes a second part that is connected to the sight unit 54 and an imaging unit 106 thereof (to be described later).

A first clutch unit 76 acting between the housing 70 and the cradle 14 comprises a clutch plate 78 depending from a cantilever arm 80 projecting from the upstanding arm 20 of the cradle mount 14. The clutch plate 78 and arm 80 constitute a third part of the coupling unit that is connected to the support 14. A peripheral portion 82 of the clutch plate 78 extends between a par of pads 84 and 86 in an operating calliper 88 mounted upon the exterior of the adjacent sidewall 66 of coupling housing 70. Actuation of the clutch unit 76 locks the housing unit 70, and hence the sight unit 54, to the cradle 14.

A second clutch unit 90 inside the housing 70 comprises a clutch plate 92 depending from the shaft 60 with a peripheral portion 94 extending between a pair of pads 96 and 98 in an operating calliper 100 mounted upon the interior of sidewall 68 Actuation of the clutch unit 90 locks the housing unit 70, and the sight unit 54, to the shaft 60, and hence to the weapon body 10.

The clutch units 76 and 90 are operated by solenoids (not shown) connected to the control button 42, which is a changeover switch. Consequently, when one clutch unit is actuated, the other is not. When clutch unit 76 is released and clutch unit 90 engaged, coupling housing 70 is locked to weapon body 10 and so can pivot in elevation relative to the cradle 14, the elevation angle being measured by an angle encoder, i.e. a resolver 102, mounted around bearing 64 to measure the angular displacement between the housing 70 and the shaft 60. When clutch unit 76 is engaged and clutch unit 90 released, the housing 70 is locked to the cradle 14 but released from the shaft 60. Consequently, the weapon body 10, and barrel 12, can pivot in elevation independently of the aiming system 16 and its sight unit 54.

At all times, however, the aiming system 16 will rotate with the weapon body 10 in azimuth as cradle 14 rotates about bearing 32. The azimuthal rotation is measured by a second resolver 104 mounted around the bearing 32, for providing a signal representing rotation of cradle 14 about pintle 30 which is fixed to the tripod 38.

Stops (not shown) are provided to limit the movement of the housing 70 relative to the shaft 60 and cradle 14 to predetermined angles.

Figure 4:
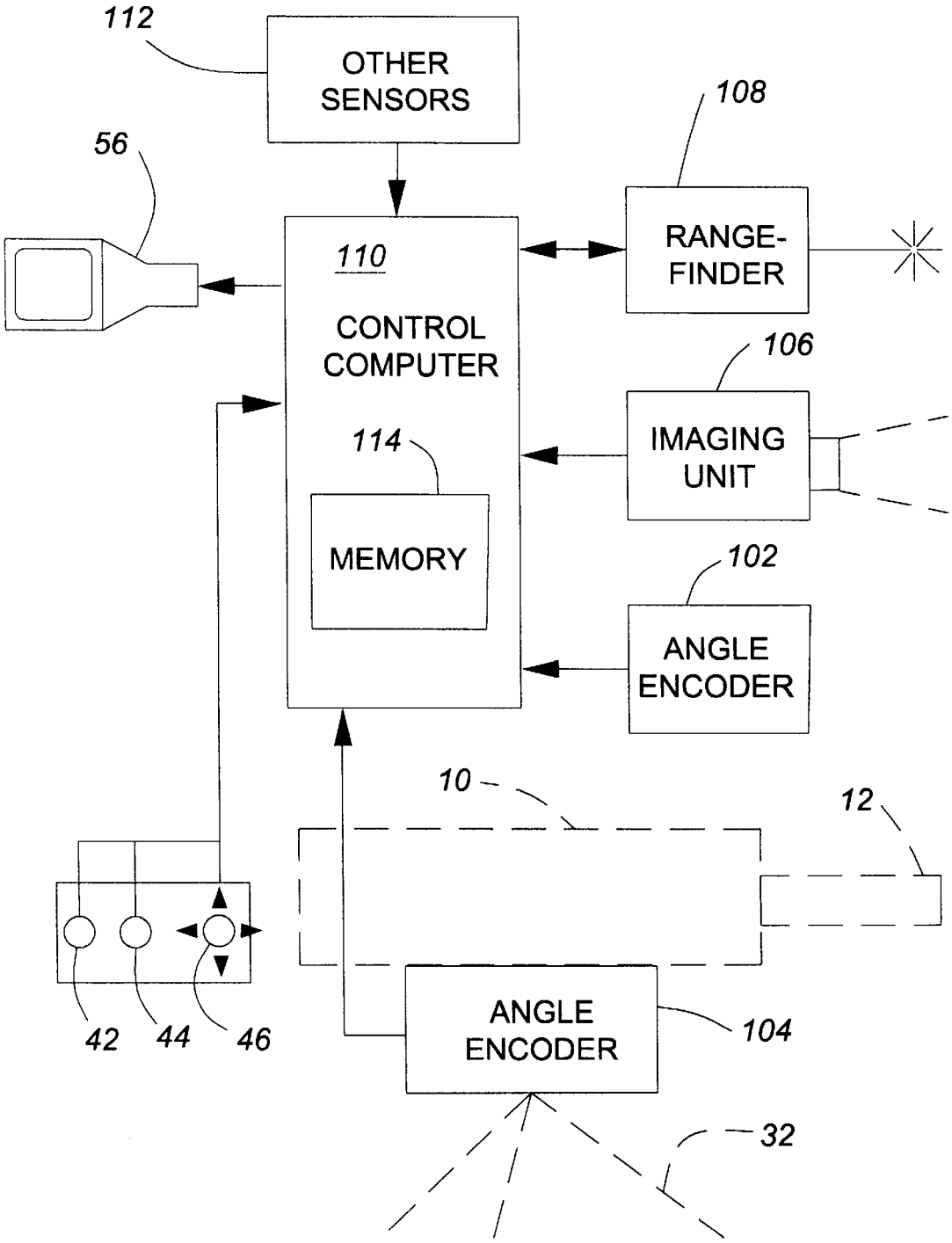
FIG. 4 is a schematic system diagram showing the electrical connections between components of the weapon and its aiming system.

The sight unit 54 also houses an imaging unit 106 and a laser rangefinder 108 which, together with the resolvers 102 and 104, and the control buttons 42, 44 and 46, are connected to a control computer 110, also housed in the sight unit 54. As illustrated in FIG. 4, the control computer 110 also is connected to other sensors 112 which supply data for use, with the range, in calculating the ballistic solution. These other sensors 112 may include inclinometers mounted in the sight unit 54 for providing signals representing cant and elevation of the imaging unit 106 relative to the ground. The control computer unit 110 has a memory 114 for storing readings from resolvers 102 and 104, rangefinder 108, and other sensors 112, and is programmed to generate and output the video graphics for the display unit 56, including graphics artefacts for an aiming reticle 116 and a rangefinder reticle 118 (see FIG. 5A). It also handles fuse programming, power management for the aiming system, and so on.

The imaging unit 106 is fixed to the sight unit 54 and hence to the second part of the coupling unit 52, i.e. the housing 70. The imaging device 106 may be of the kind which uses a CCD device to capture an electronic image of the field of view, the computer unit 110 including an artefact generator (not shown) for overlaying upon the image, an aiming reticle and a laser rangefinder reticle or spot. The computer unit 110 would control the artefact generator to position the reticles in the image. Alternatively, the imaging device 106 might display an optical image with an electronic overlay to provide the electronically-generated aiming reticle and, perhaps, laser rangefinder reticle.

During assembly of the aiming system, the position of the laser rangefinder 108 relative to the imaging device 106 will be adjusted physically to effect coarse alignment of their sight lines. A more precise calibration will then be made with the imaging device 106 viewing a nearby screen. The rangefinder 108 will be operated, causing it to illuminate a spot near the aiming reticle. The position of the rangefinder reticle 118 will be adjusted electronically, using the control computer 110, to align it with the spot. The coordinates for this position will be stored in the control computer's memory 114 so that the rangefinder reticle 108 will always appear in the same position in the displayed image of the field of view of the imaging device 106.

The aiming system 16 will be calibrated in the factory and installed onto the weapon afterwards, usually "in the field". Once the sight unit 54 has been installed onto the weapon, by engaging the tapered portions of the shaft 60 and the journal 24, it must be "boresighted". A boresighting device displaying an aiming point marker (not shown) is placed into the barrel 12 and the aiming reticle 106 is adjusted electronically until it is precisely aligned with the aiming point marker. These "datum" coordinates of the aiming reticle 106 are stored in the memory 114 of the control computer 110. It should be noted that this datum position of the aiming reticle 106 represents a zero-range aiming point or zero-range ballistic solution. Subsequently, the position of the aiming reticle 106 will be adjusted by the control computer 110 to give the required offset for superelevation and other factors in the ballistic solution. It should be noted that the rangefinder reticle 118 will not be coincident with the aiming reticle 106 in the displayed image, reflecting the fact that the sight line of the rangefinder 108 is offset relative to the sight line of the imaging device 106.

Normal use of the weapon system will now be described with reference to FIGS. 5A to 5D in which, for purposes of illustration, the image displayed by display unit 56 is shown much simplified.

Figure 5A:
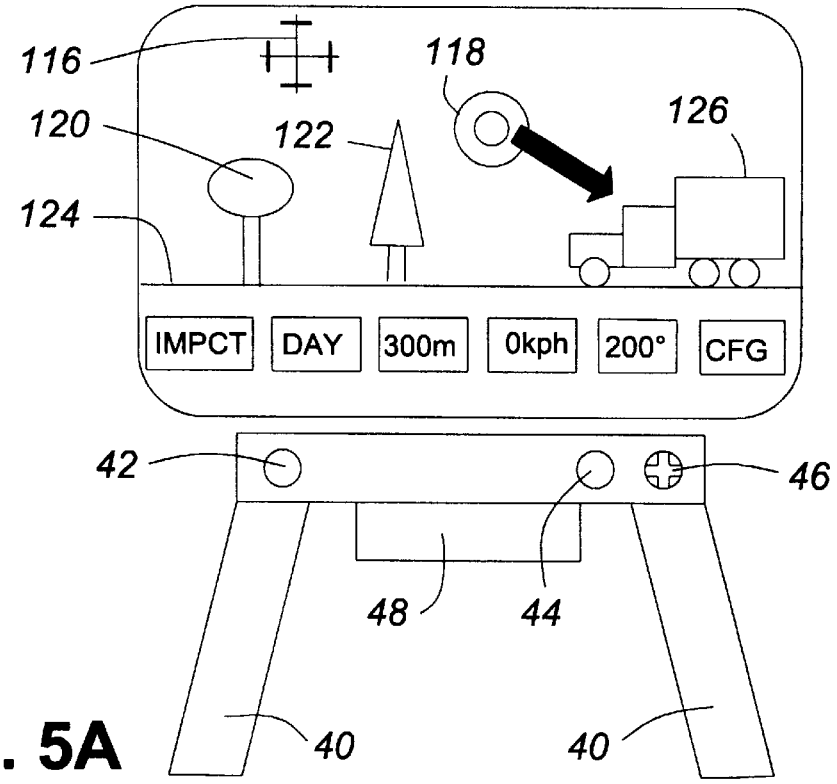
FIGS. 5A to 5D illustrate images displayed during normal operation of the weapon.
Figure 5B:
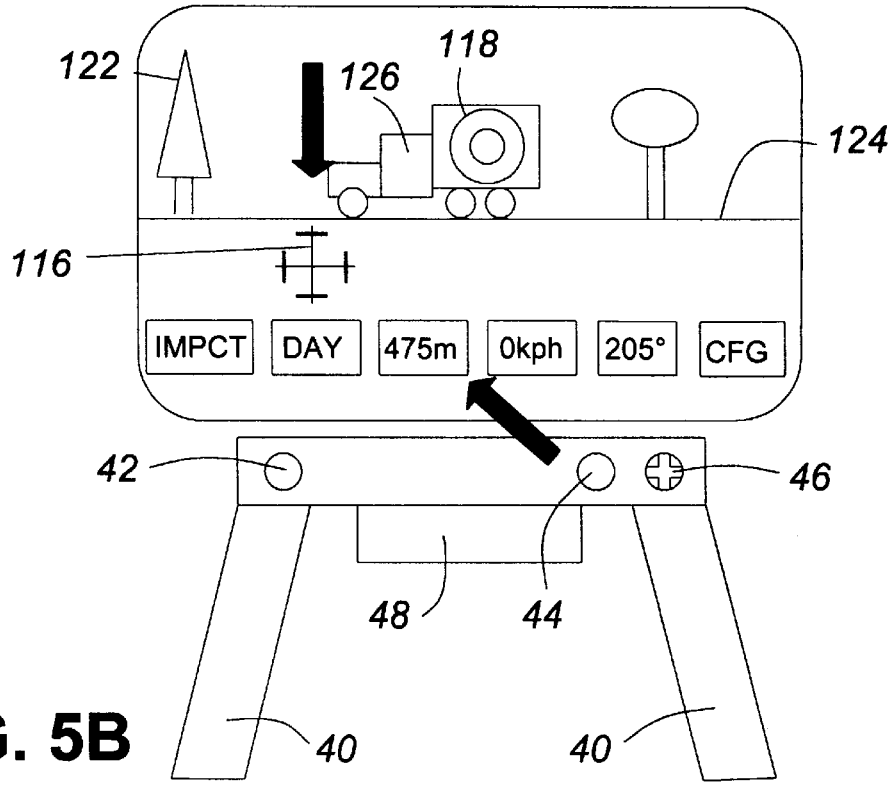
Figure 5C:
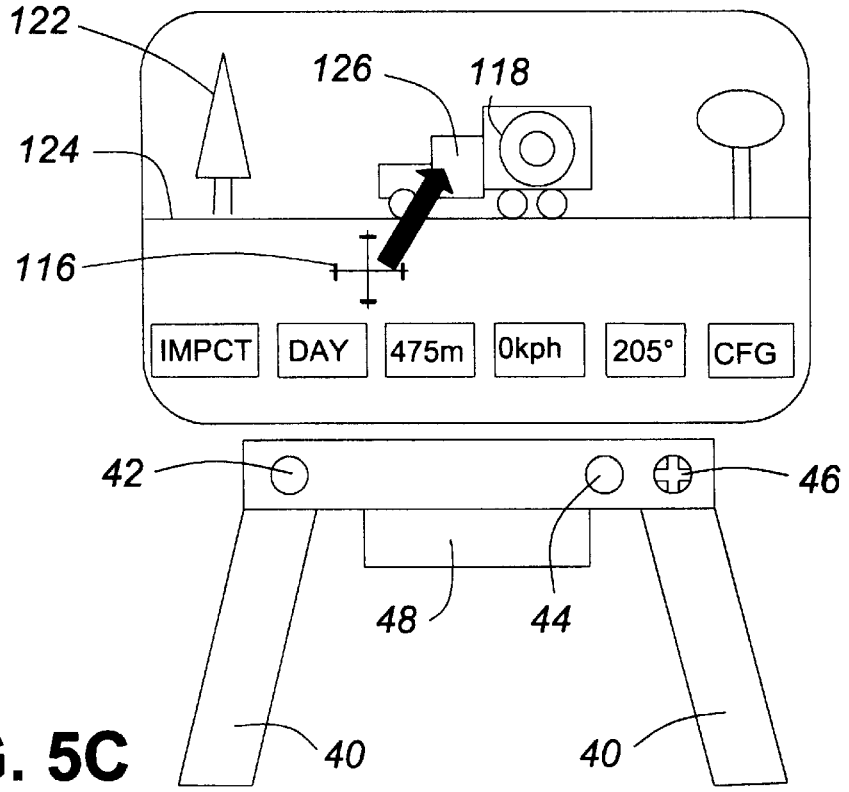
Figure 5D:
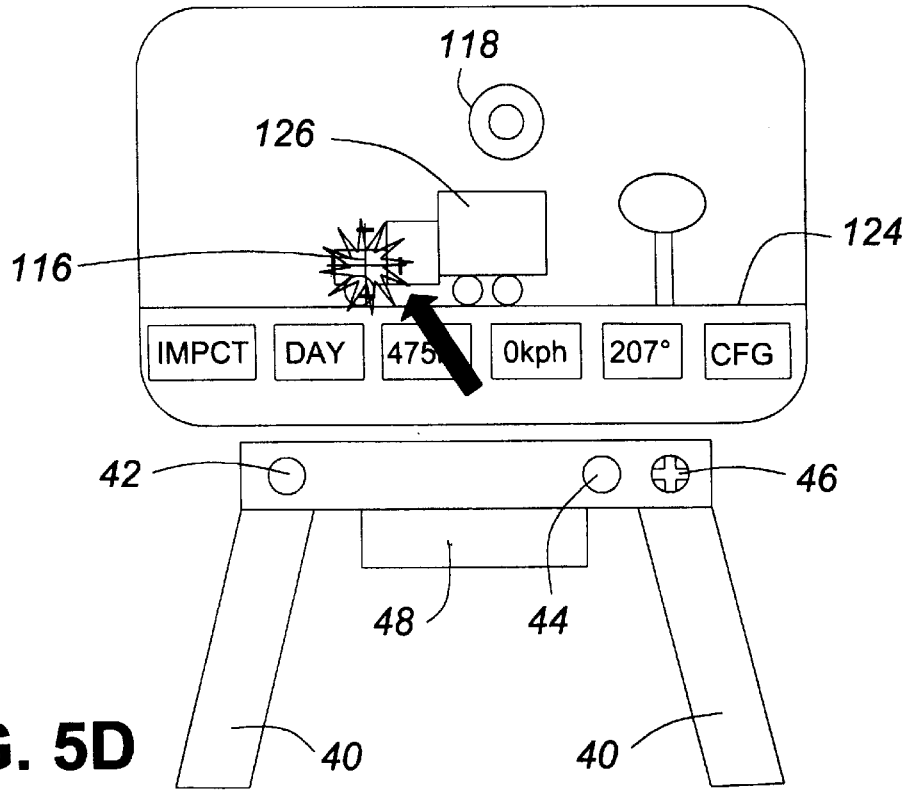
Figure 6:
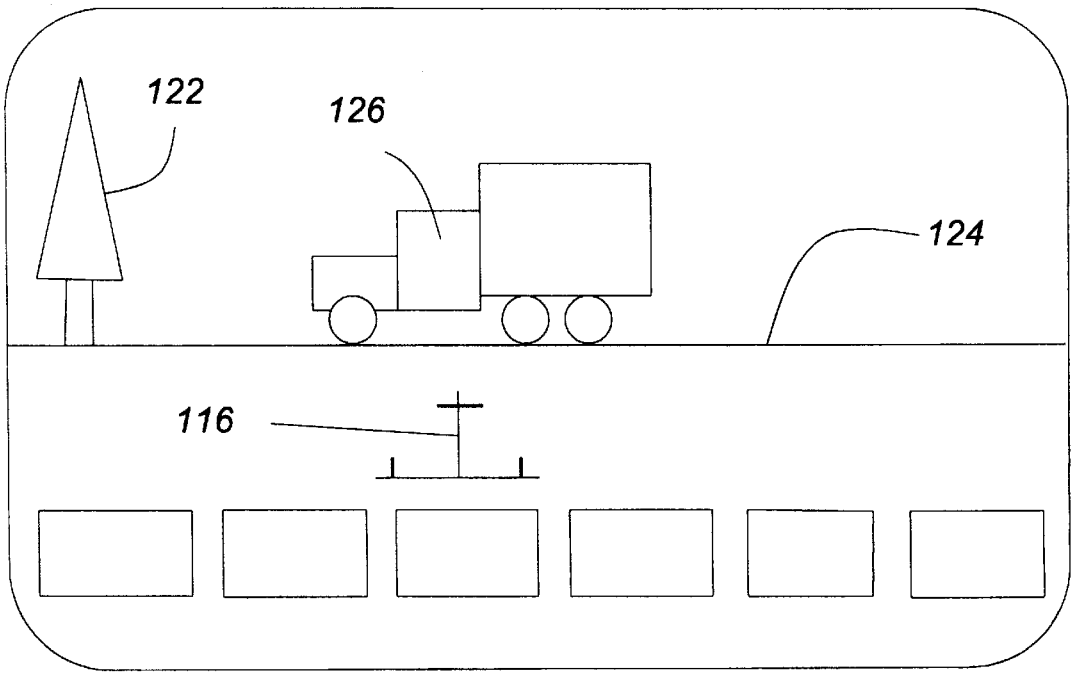
FIG. 6 illustrates an image with a modified aiming reticle.

Referring first to FIG. 5A, the image in display unit 56 comprises the scene within the field of view of the imaging device 106 and shows trees 120 and 122 adjacent a roadway 124 along which is travelling a target vehicle 126. The aiming reticle 116 and rangefinder reticle 118 are overlaid upon the scene. To engage a target, the user operates switch 42 to engage clutch unit 90 and disengage clutch unit 76, locking the sight unit 54 to the weapon body 10. Using handles 40, the user moves the weapon body 10, and with it the laser rangefinder 108, in azimuth and elevation until the rangefinder reticle 118 is upon the target vehicle 126, and then depresses pushbutton 44 to operate the rangefinder 108. Upon receipt of the range from the rangefinder 108, the control computer 110 calculates the ballistic solution including, inter alia, the amount of superelevation required and applies a corresponding offset value to the displacement signal from resolver 102, causing the aiming reticle 116 to be displaced downwards an equivalent amount, as shown in FIG. 5B. The user then pivots the weapon barrel 12 upwards, causing the aiming reticle 116 to move upwards as shown in FIG. 5C, positions the aiming reticle 116 upon the target 126, as shown in FIG. 5D, and fires the weapon by operating trigger 48.

Where the amount of superelevation is large enough for the offset to displace the aiming reticle 116 beyond the boundary of the field of view of the imaging device 106, the control computer 110 does not move the aiming reticle 116 off the screen, but rather moves it until it is adjacent the edge of the display, and hence still visible. In doing so, the control computer 110 applies only part of the superelevation offset to the aiming reticle 116 and stores the balance of the offset in memory 114. To ensure that the user is aware that the aiming reticle 116 temporarily is not tracking the movement of the barrel 12, the control computer 110 changes the appearance of the aiming reticle 116, conveniently by omitting the lower portion of the aiming reticle 116, as illustrated in FIG. 6, as if part of the aiming reticle 116 were beyond the edge of the display.

The user operates switch 42 to engage clutch unit 76 and disengage clutch unit 90, locking the sight unit 54 to the cradle 14 and disengaging it from the weapon barrel 12. The user then elevates the barrel 12, as before, leaving the imaging device 106 stationary, thus keeping the target 126 in view. When the control computer 110 detects that the barrel 12 has been moved upwards by an amount equivalent to the balance of the offset stored in memory, i.e. the aiming point of the barrel 12 corresponds to the position of the aiming reticle 116 at the edge of the display, it restores the aiming reticle 116 to its original appearance and thereafter moves the aiming reticle 116 to track the further upwards movement of the barrel 12. The user adjusts the aiming point in azimuth and elevation until the aiming reticle 116 is upon the vehicle target 126, and fires the weapon as before.

In order to engage another target which is at a different range, the user may operate switch 42 to lock the sight unit 54 to the weapon body 10 again and move both together until the new target is in view. The user then will repeat the sequence, beginning with the operation of the rangefinder 108.

An advantage of embodiments of the present invention is that, because the target is in view continuously, multiple targets can be engaged in quick succession, especially if they are at approximately the same range. Such a situation might arise, for example, where a number of vehicles are travelling along a path running across the field of view. Thus, having followed the above sequence to obtain the range of a first vehicle, and fire at it, the user may immediately move the weapon barrel 12 until the aiming reticle 116 is upon another vehicle and fire at that vehicle. If desired, the user can check the range of the second vehicle by operating the rangefinder 108, in which case the control computer 110 will offset the aiming reticle 116 slightly to account for difference between the ranges of the first and second vehicles. The clutch 90 may remain disengaged, and clutch 76 engaged, while this second vehicle is being targeted.

Providing that the second and any subsequent target vehicles are within the field of view, they can be engaged in this way without any adjustment of the position of the sight unit 54, allowing the targets to be engaged in quick succession.

In the event that the second vehicle is moving at such a speed or in such a direction that it cannot be engaged before it is lost from view, the clutches 76 and 90 can be operated to entrain the sight unit 54 to move with the weapon barrel 12 allowing the user to move the imaging unit 106 until the target is in view again. The target acquisition and firing sequence can then be repeated as before.

It should be appreciated that, if the second vehicle is moving towards the weapon, the aiming reticle 116 will be offset upwards and the user will have to move the weapon's barrel 12 downwards. It should also be appreciated that the ballistic solution will usually offset the aiming reticle 116 sideways too. In the case of grenade machine guns, however, the offset downwards usually will be much greater.

Advantageously, because the sight unit 54 does not need to be moved in the interval between offsetting the aiming reticle 116 and firing the weapon, and the user can keep the target in view, the user can observe any changes in, or movement of, the target while elevating or depressing the weapon barrel to allow for the offsetting of the aiming point.

It should also be noted that the weapon can be superelevated very quickly because it is only necessary to get the aiming reticle 116 back into the field of view. Thereafter, the user can aim the weapon precisely before firing. This is especially advantageous when aiming at different targets in quick succession.

As mentioned in the introduction, many potential targets have the capability of detecting that they have just been targeted by a laser or similar "radiating" rangefinder, and take evasive action. Embodiments of the invention can be used in such a way as to avoid directing the rangefinder at the target itself. Thus, referring to FIG. 5A again, the user could aim the laser rangefinder 108 at the tree 122 immediately adjacent the roadway 124 and determine its range. The aiming reticle 116 would be displaced downwards as before. Once the user had elevated the barrel 12 by the corresponding angle, the user would position the aiming reticle 116 upon the target vehicle 126 and fire the weapon. The control computer 110 could be programmed to allow the user to adjust the range reading slightly to compensate for the distance between the tree 122 and the middle of the roadway 124.

It will be appreciated that the target vehicle 126 need not be in view when the tree 122 is ranged. While waiting for the vehicle to reach a suitable spot on the roadway 124, the user could obtain the range of the tree 122, and even apply any required superelevation to the barrel 12, allowing quicker engagement when the vehicle 126 arrived at the spot.

Embodiments of the invention may also be used to obtain and store the ranges of predesignated targets, enabling subsequent "blind" engagement of a target, perhaps while it is obscured by smoke, or enabling the user to fire at the predesignated target by a when instructed to do so by a remote "spotter". Such predesignation will now be described with reference to FIGS. 7A through 7D.

Figure 7A:
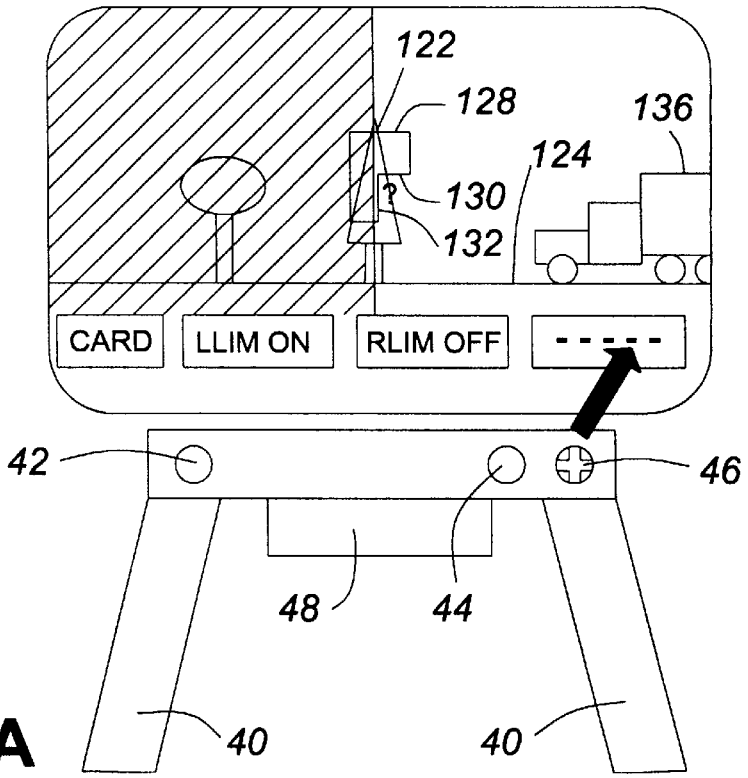
FIGS. 7A to 7H illustrate images displayed during operation of the aiming system to predesignate targets, and during engagement of a target after such predesignation.
Figure 7B:
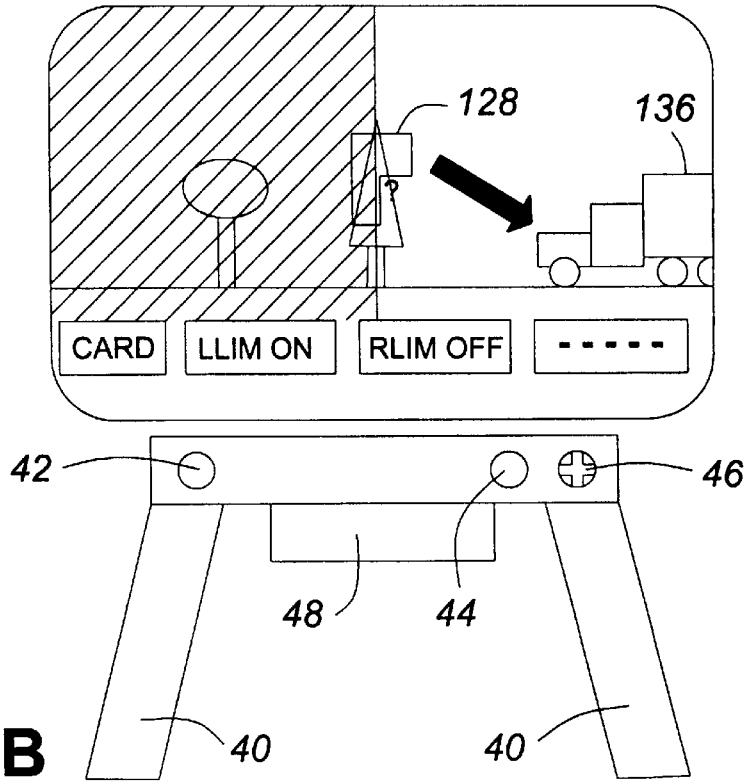
Figure 7C:
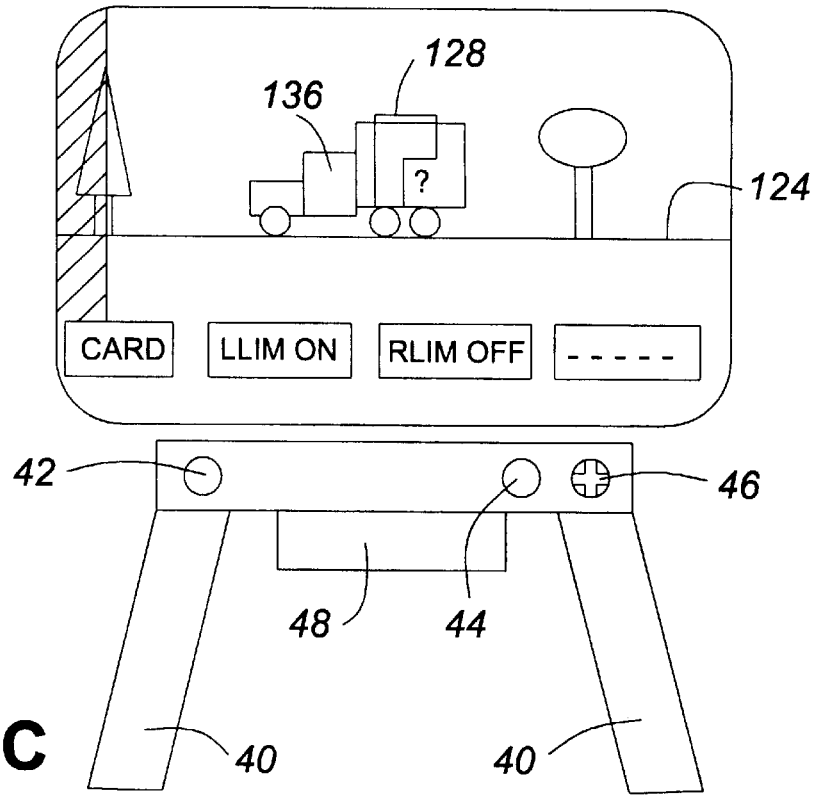
Figure 7D:
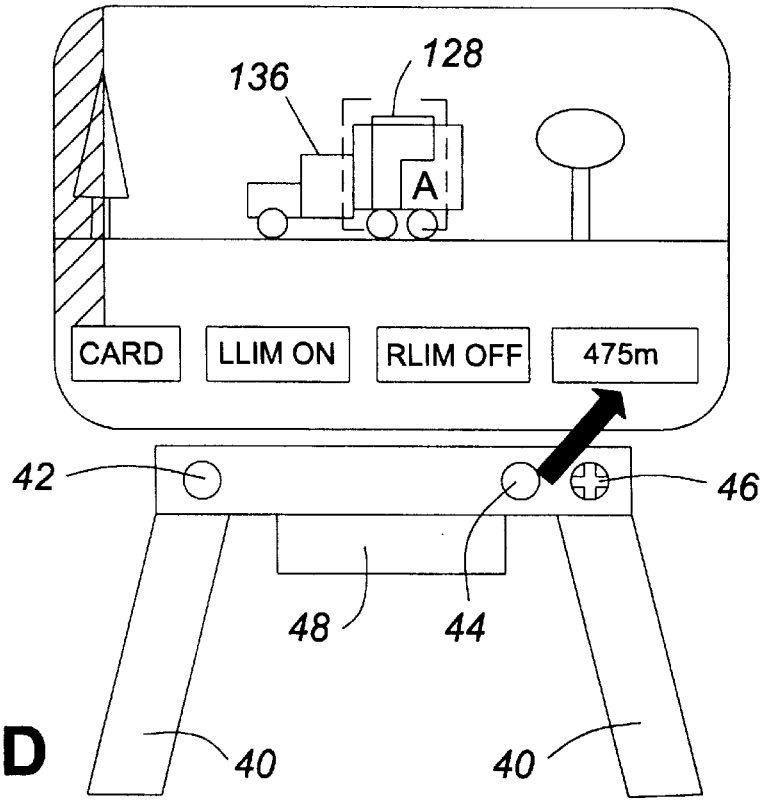

Referring to FIG. 7A, the user first operates pushbutton 46, which is a four-way toggle switch, to cause the control computer 110 to display a menu (not shown) and selects from it a "predesignation" mode. As shown in FIG. 7A, the control computer 110 changes the rangefinder reticle 118 to a predesignation icon 128 having the shape of a square minus one quadrant, with a query sign "?" in the space left by the missing quadrant, indicating that the aiming system is in predesignation mode. The three quadrant icon 128 is preferred because it has a centre defined by converging edges 130 and 132, which facilitates aiming. With the sight unit 54 locked to the weapon, the user moves the weapon until the predesignation reticle 128 is centred upon the first predesignated target, as illustrated in FIGS. 7B and 7C, and operates the laser rangefinder 108. Upon receipt of the range measurement signal, the control computer 110 generates square brackets around the predesignation icon 128 and changes the query sign "?" to a letter "A", as an identifier for that predesignated target. The control computer 110 displays the range in a box 134 at the bottom of the display and stores the range in memory 114, together with the coordinates of the predesignated target A, as derived from the angle encoders 102 and 104 and the elevation inclinometer (not shown) previously mentioned as one the "other sensors" 112 or other gravity sensor which measures elevation relative to the ground. Optionally, the control computer 110 may then display a message "ADJUST RANGE" and allow the user to modify the stored range using toggle switch 46.

The control computer 110 then changes the letter "A" to a query sign "?" again and the user may repeat the procedure for other predesignated targets, storing their ranges and coordinates in the computer's memory 114, each with a different letter a san identifier. Such a predesignated target might be a vehicle 136 , as illustrated, which is not a target itself but occupies a position which later might be occupied by a target vehicle. Another example is a bridge which, at the time, is empty. When all of the predesignated targets have been ranged, the user switches the weapon aiming system to its normal mode and the normal rangefinder reticle 118 is displayed.

Figure 7E:
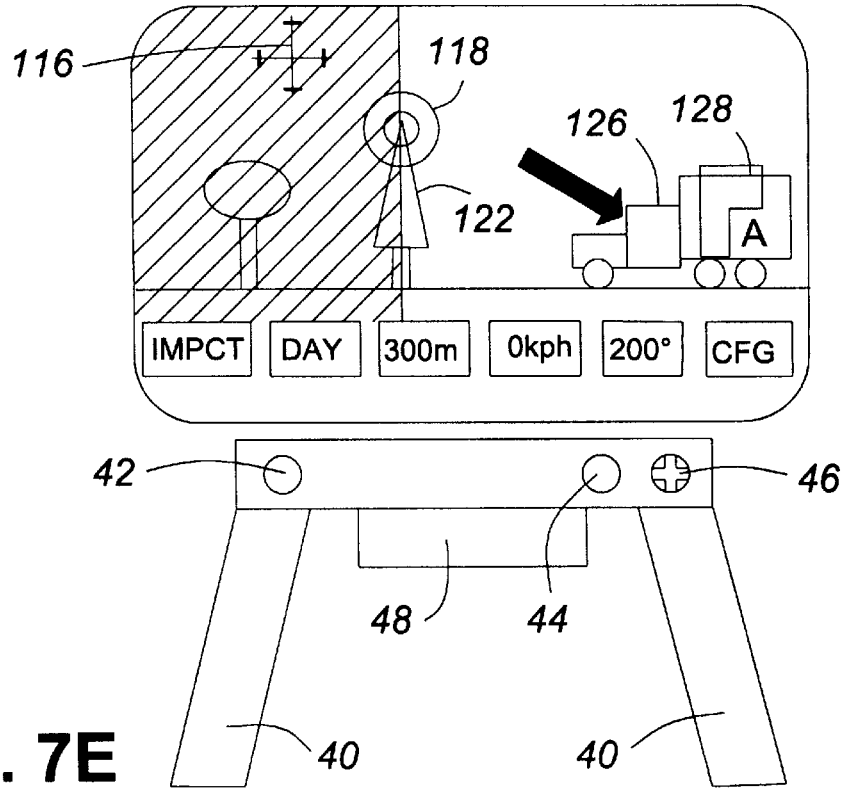
Figure 7F:
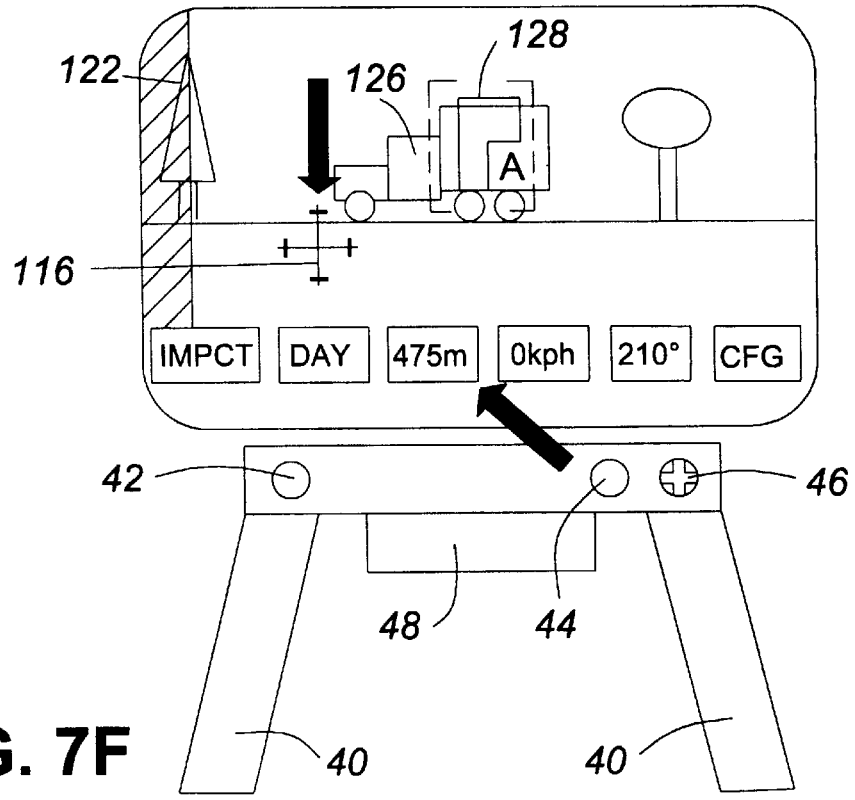
Figure 7G:
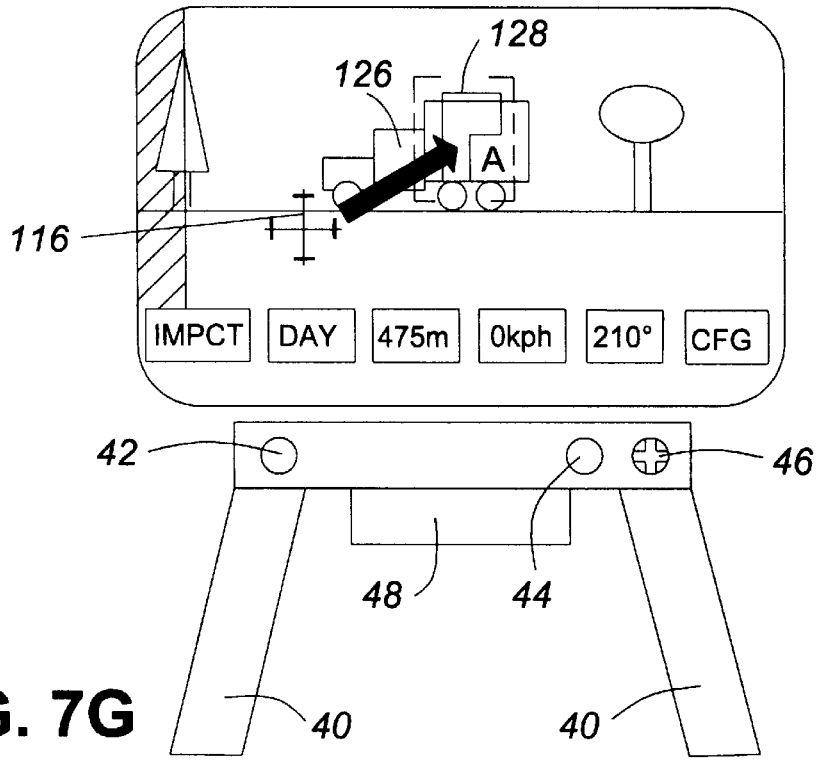
Figure 7H:
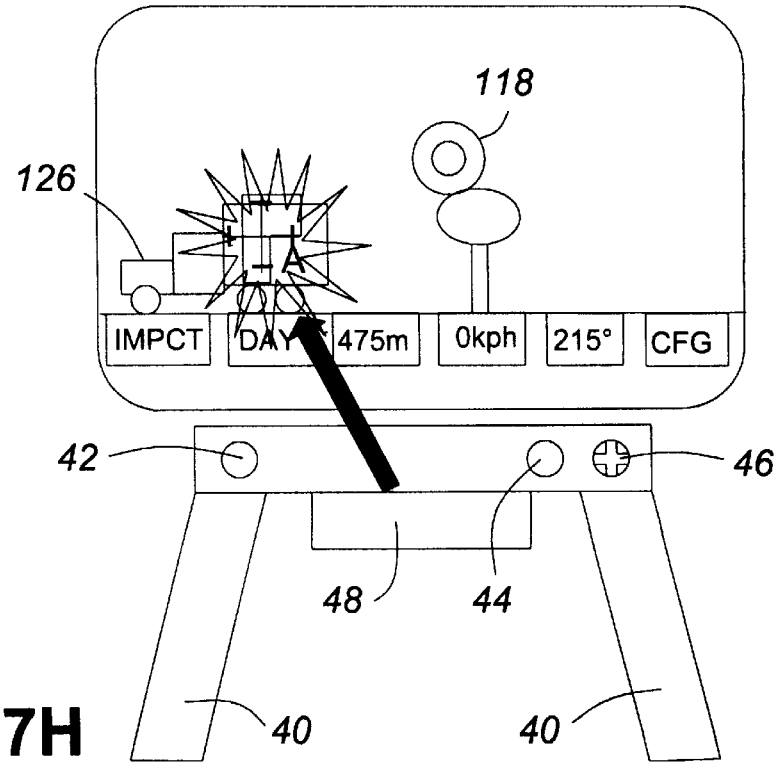

As illustrated in FIG. 7E, when the user subsequently points the laser rangefinder 108 within a preset distance from a predesignated target, the control computer 110 will detect this and display the predesignation icon 128 at the coordinates of the predesignated target. Assuming that he decides to engage the target, the user places the normal rangefinder reticle 118 upon the predesignated target and operates the rangefinder 108. As shown in FIG. 7F, the control computer 110 inhibits the operation of the rangefinder 108 and, instead, displays the square brackets around the predesignation icon 128 and the previously-stored range. It also calculates the ballistic solution and offsets the aiming reticle 116 in the usual manner. As shown in FIG. 7G, the user moves the barrel 12 to bring the aiming reticle 116 onto the target and fires the weapon, as illustrated in FIG. 7H.

As before, the user will operate the clutches 76 and 90 as necessary to keep the target in view while acquiring the target and correcting for superelevation offsets.

Figure 8:
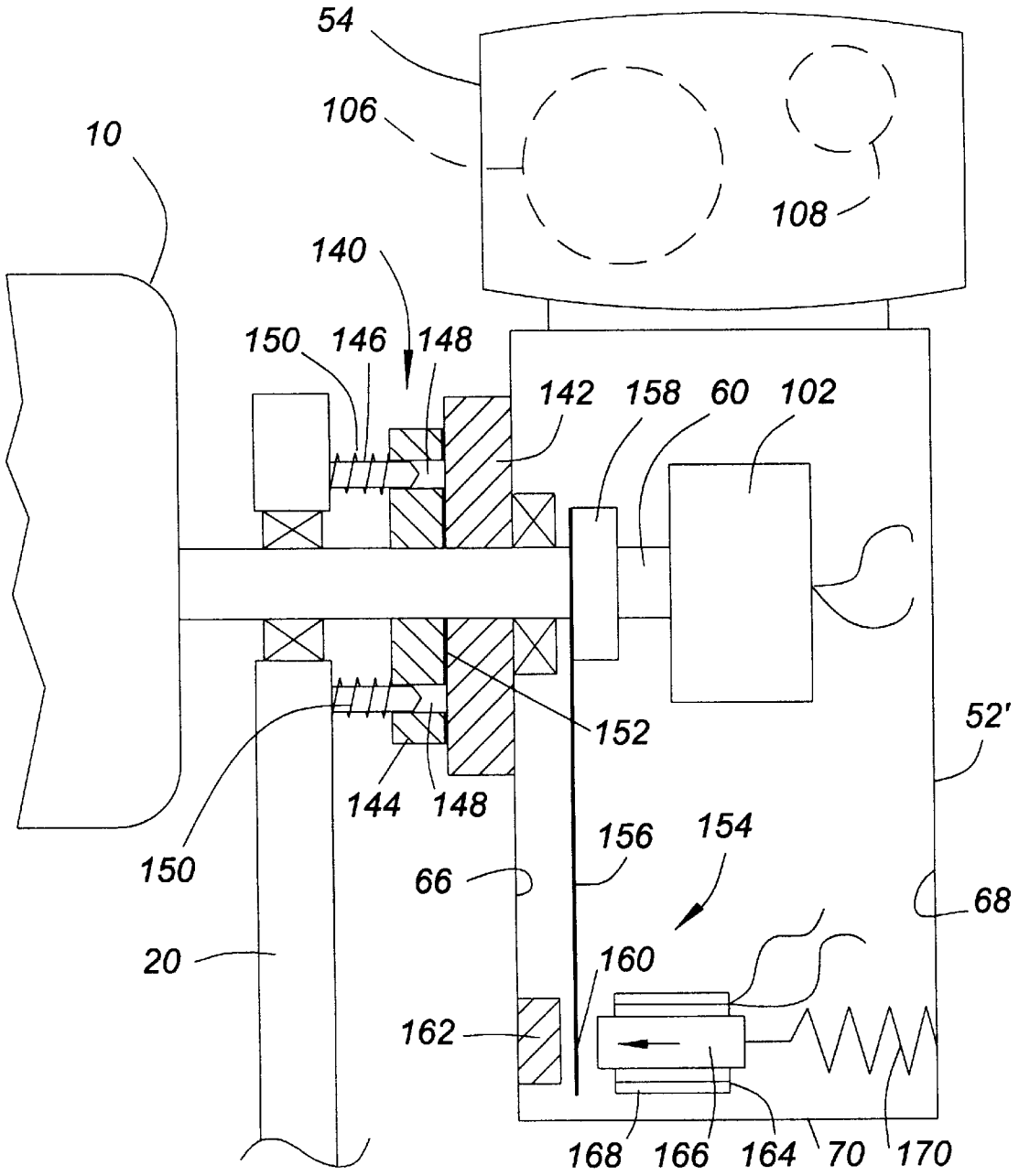
FIG. 8 is a schematic partial view of the weapon and aiming system of FIG. showing details of the modified coupling unit interconnecting them.

The present invention comprehends various modifications to the described embodiments. FIG. 8 illustrates the modified coupling unit 52", the exterior of which is shown in FIG. 2 and in which the clutch 76 is replaced by a slip clutch 140 which acts continuously to entrain the coupling unit 52, and with it the sight unit 54, to maintain its position relative to the cradle 14. The sight unit 54 shown in FIG. 8 differs from that illustrated in FIG. 3 in that the bearing 64 is omitted and the shaft 60 stops short of the housing sidewall 68. The angle encoder 102 is mounted inside the housing 70.

The slip clutch unit 140 comprises an annular copper disc 142 secured to the exterior of sidewall 66 and around the shaft 60. A second annular disc 144 is mounted upon the opposing wall of the cradle 14 by means of a set of dowels 146 which project from the cradle wall 20 and engage in corresponding holes 148 in the second disc 144. A set of compression springs 150 are each mounted around a respective one of the dowels 146. When the coupling unit 52 is mounted upon the weapon by attaching the shaft 60 to the journal 24, the springs 150 urge the second disc 144 into contact with the copper disc 142. A layer 152 of suitable friction material is provided on the surface of the second disc 144 and abuts the copper disc 142 to provide a required amount of friction. The second clutch unit 154 comprises a clutch plate 156 fixed to a boss 158 on the shaft 60 and depending with its peripheral portion 160 adjacent a single pad 162 fixed to the housing 70. An actuating solenoid 164 mounted upon the housing 70 has an armature 166 and an operating coil 168. A spring 170 acts between the housing 70 and the armature 166 and, when the coil 168 is de-energized, urges the armature 166 to clamp the clutch plate 156 against the pad 162.

The second clutch 154 is normally-engaged and overcomes the frictional force exerted by slip clutch 140 so that the coupling unit housing 70 will move with shaft 60 as the weapon barrel 12 is elevated. The slip clutch 140 will act as a brake, but the frictional force would be set low enough to allow the weapon to move relatively freely as the user moved it to compensate for the offsetting of the aiming reticle 116.

When the second clutch 154 is disengaged, i.e. when solenoid coil 164 is energized by operation of switch 42, the slip clutch 140 provides sufficient frictional force to prevent the housing 70 from moving in elevation relative to the cradle 14 as the weapon barrel 12 is elevated by the user.

It should be appreciated that, although the clutches 76, 90 and 154 are each described as having a single plate, in practice, they could be multi-plate clutches.

An advantage of embodiments of the invention is that the components of the aiming system can be housed in a single housing and quickly and easily mounted upon the weapon. A specific advantage of housing the imaging unit 106 and rangefinder 108 together is that their relative positions can be fixed and aligned in the factory. This not only avoids adjustments in the field, but also allows the mounting arrangement to be designed so that the alignment is less likely to be lost due to vibration when the unit is in use.

Although the invention has been described as applied to a military weapon, specifically a grenade machine gun, it is envisaged that it could be applied to other weapons which employ superelevation to launch a projectile. Moreover, in this specification, the term "weapon" is not limited to military weapons but embraces nonilitary superelevating devices which launch projectiles, such as might be used in construction, or even devices which launch a "projectile" in the form of fluid stream.

Although embodiments of the invention have been described and illustrated in detail, it is to be clearly understood that the same is by way of illustration and example only and not to be taken by way of the limitation, the spirit and scope of the present invention being limited only by the appended claims.

What is claimed is:

1. A weapon system comprising a weapon and an aiming system both mounted upon a support, the weapon having a barrel unit and the aiming system comprising:

(i) an imaging unit for providing an image of a scene within a field of view of the imaging unit;

(ii) a display unit for displaying the image;

(iii) a coupling unit having a first part connected to the weapon for rotation in elevation with the barrel unit, a second part connected to the imaging unit and a third part connected to the support;

the coupling unit having a first operational state in which the coupling unit fixes the imaging unit relative to the support while allowing elevation of the barrel unit relative thereto and a second, alternative state in which the coupling unit entrains the imaging unit to move with the barrel unit relative to the support, (iv) angle encoding means for providing a displacement signal representing displacement of the imaging unit in elevation relative to said first part; and (v) control means comprising means for controlling the coupling unit to select the first state and the second state alternatively and means responsive to the displacement signal for determining when a required change in elevation of the barrel unit relative to the support with the coupling unit in the first operational state has been effected and causing the display to provide an indication thereof.

2. A weapon system according to claim 1, further comprising a rangefinder for providing a range of a target in the field of view of the imaging unit, and wherein the control means comprises:

a control computer unit comprising means for providing upon said image displayed by the display unit an aiming reticle representing an aiming point of the barrel once the imaging unit has been boresighted to the barrel unit and a ranging reticle representing an aiming point of the rangefinder, means for controlling the reticle providing means to adjust the position of the aiming reticle in dependence upon the displacement signal, and means for computing a required change in elevation of the barrel unit in dependence upon a range measured by the rangefinder and applying a corresponding offset to the displacement signal so as to displace the aiming reticle relative to the field of view in a direction opposite the required elevation change.

3. A weapon system according to claim 2, wherein the control computer is operable to detect that the offset would displace the aiming reticle beyond limits in the displayed scene, apply a part of the offset to maintain the aiming reticle at a position adjacent a corresponding edge of the field of view and monitor the remaining offset, restoring movement of the aiming reticle with the weapon barrel unit once the barrel unit has been displaced by an elevation angle greater than that corresponding to said remaining offset.

4. A weapon system according to claim 2, wherein the control unit is operable to change the appearance of the aiming reticle while the aiming point is outside the field of view.

5. A weapon system according to claim 3, wherein the control unit is operable to change the appearance of the aiming reticle while the aiming point is outside the field of view.

6. A weapon system according to claim 1, wherein the imaging unit is mounted alongside the barrel unit and is coupled to a separate display unit mounted immediately above a rear portion of the barrel unit.

7. A weapon system according to claim 2, wherein the control computer comprises means for storing coordinates of at least one predesignated target, together with an associated range, and displaying an icon at the corresponding position in said image when the line of sight of the imaging unit is coincident with or near the predesignated target.

8. A weapon system according to claim 1, wherein the weapon barrel unit and the coupling unit are rotatable in elevation about a common axis.

9. A weapon system according to claim 1, wherein the coupling unit comprises a first clutch unit acting between the first part and the second part and engageable to entrain the imaging unit to move with the barrel unit in elevation relative to the support, a second clutch unit acting between the second part and third part and engageable to secure the imaging unit to the support, and switch means for engaging the first clutch unit while simultaneously disengaging the second clutch unit and vice versa.

10. A weapon system according to claim 1, wherein the coupling unit comprises a first clutch unit acting between the first part and the second part and engageable to entrain the imaging unit to move in elevation with the barrel unit, and a slip clutch acting continuously between the second part and the third part with sufficient force to retain the imaging unit in fixed elevational relationship with the support, providing the first clutch unit is disengaged, but insufficient force to prevent said movement of the imaging unit when the first clutch unit is engaged.

11. A weapon system according to claim 1, wherein the means for controlling the coupling unit comprises a user-operable switch.

12. An aiming system for use mounted to a weapon having a barrel unit and a support, the barrel unit being rotatable in elevation relative to the support, the aiming system comprising an imaging unit, a display unit, a coupling unit, angle encoding means and control means, wherein:

(i) the imaging unit comprises means for providing an image of a scene within a field of view of the imaging unit;

(ii) the display unit is for displaying the image, (iii) the coupling unit has a first part adapted for connection fixedly to the barrel unit, a second part fixedly connected to the imaging unit and a third part for connection to the support;

the coupling unit having a first operational state in which the coupling unit fixes the second part relative to the third part while allowing movement of the first part relative thereto and a second, alternative state in which the coupling unit entrains the Second part to move with the first part relative to the third part, (iv) the angle encoding means being operable to provide a displacement signal representing displacement of the second part relative to said first part; and (v) the control means comprising means for controlling the coupling unit to select the first state and second state alternatively and means responsive to the displacement signal for determining when a required displacement of the first part relative to the third part with the coupling unit in the first operational state has been effected and causing the display unit to provide an indication thereof.

13. An aiming system according to claim 12, further comprising a rangefinder for providing the range of a target in the field of view of the imaging unit, and wherein the control means comprises:

computer unit comprising means for overlaying upon said image displayed by the display unit an aiming reticle movable relative to said image in dependence upon relative displacement between the first part and the second part, and a ranging reticle representing an aiming point of the rangefinder, means for adjusting the position of the aiming reticle in dependence upon the displacement signal and means for computing a desired change in said relative displacement according to a range measured by the rangefinder and applying a corresponding offset to the displacement signal so as to displace the aiming reticle relative to the field of view in a direction opposite to that corresponding to said desired change.

14. An aiming system according to claim 13, wherein the computer unit is operable to detect that the offset would displace the aiming reticle beyond limits in the displayed scene, apply a part of the offset to maintain the aiming reticle at a position adjacent a corresponding edge of the field of view and monitor the remaining offset, restoring movement of the aiming reticle with the first part once the first part has been displaced by an amount greater than that corresponding to said remaining offset.

15. An aiming system according to claim 13, wherein the computer unit is operable to change the appearance of the aiming reticle while the aiming point is outside the field of view.

16. An aiming system according to claim 14, wherein the control computer unit is operable to change the appearance of the aiming reticle while the aiming point is outside the field of view.

17. An aiming system according to claim 13, wherein the computer unit comprises means for storing coordinates corresponding to at least one predesignated position of the aiming reticle in the image, together with an associated range, and displaying an icon at said predesignated position in said image when the line of sight of the imaging unit is coincident with or near the predesignated position.

18. An aiming system according to claim 12, wherein the barrel unit and the coupling unit are rotatable in elevation about a common axis.

19. An aiming system according to claim 12, wherein the coupling unit comprises a first clutch unit acting between the first part and the second part and engageable to entrain the imaging unit to move with the first part relative to the third part, a second clutch unit acting between the second part and the third part and engageable to secure the imaging unit to the third part, and switch means for engaging the first clutch unit while simultaneously disengaging the second clutch unit; and vice versa.

20. An aiming system according to claim 12, wherein the coupling unit comprises a first clutch unit acting between the first part and the second part and engageable to entrain the imaging unit to move with the first part relative to the third part, a second clutch unit acting between the second part and the third part and engageable to secure the imaging unit to the third part, and switch means for engaging the first clutch unit while simultaneously disengaging the second clutch unit; and vice versa.

21. An aiming system according to claim 12, wherein the means for controlling the coupling unit comprises a user-operable switch.

* * * * *